US008698553B2

(12) United States Patent
Jung

(10) Patent No.: US 8,698,553 B2
(45) Date of Patent: Apr. 15, 2014

(54) INTERNAL VOLTAGE GENERATING CIRCUIT

(71) Applicant: SK hynix Inc., Gyeonggi-do (KR)

(72) Inventor: Hae-Kang Jung, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 13/717,399

(22) Filed: Dec. 17, 2012

(65) Prior Publication Data

US 2013/0300496 A1 Nov. 14, 2013

(30) Foreign Application Priority Data

May 9, 2012 (KR) ..... 10-2012-0049292

(51) Int. Cl.
*G05F 1/10* (2006.01)

(52) U.S. Cl.
USPC ..... 327/540

(58) Field of Classification Search
USPC ..... 327/308, 530, 538, 540
See application file for complete search history.

(56) References Cited

U.S. PATENT DOCUMENTS 7,580,288 B2 * 8/2009 Choy et al. ..... 365/185.18
8,384,469 B2 * 2/2013 Hashimoto et al. ..... 327/540
8,416,012 B2 * 4/2013 Ashida ..... 327/540

FOREIGN PATENT DOCUMENTS

KR 1019940010508 5/1994
KR 1020060027058 3/2006

* cited by examiner

*Primary Examiner* — Jeffrey Zweizig
(74) *Attorney, Agent, or Firm* — IP & T Group LLP

(57) ABSTRACT

An internal voltage generating circuit may include a first pull up resistor activated by a first range signal and connected between a pull up voltage terminal and a pull up common node; a second pull up resistor activated by a second range signal and connected between the pull up voltage terminal and the pull up common node; a first pull down resistor activated by the first range signal and connected between a pull down voltage terminal and a pull down common node; a second pull down resistor activated by the second range signal and connected between the pull down voltage terminal and the pull down common node; a resistor string including a plurality of series resistors connected between the pull up common node and the pull down common node; and a voltage selection circuit select voltage in response to voltage selection information.

15 Claims, 8 Drawing Sheets

VDD
VDD
RANGE 1
P1
RANGE 2
P2
211
212
240
<63>
<62>
<61>
<60>
230
<59>
VOLTAGE SELECTION CIRCUIT
VREF
<2>
<1>
<0>
221
222
RANGE 1
N1
RANGE 2
N2
SEL<0:5>
VSS
VSS
250
RANGE CODE
IDLE
RANGE SIGNAL GENERATION UNIT
RANGE 1
RANGE 2

INTERNAL VOLTAGE GENERATING CIRCUIT

CROSS-REFERENCE TO RELATED APPLICATIONS

The present application claims priority of Korean Patent Application No. 10-2012-0049292, filed on May 9, 2012, which is incorporated herein by reference in its entirety.

BACKGROUND

1. Field

Exemplary embodiments of the present invention relate to an internal voltage generating circuit, and more particularly, to the circuit of reduced voltage setting time and power consumption.

2. Description of the Related Art

Various types of semiconductor devices use various internal voltages having different levels from levels of external voltages supplied from the outside. For example, a memory device uses core voltage VCORE used in a core region, reference voltage VREF used in a buffer, and the like.

A common scheme for generating the internal voltages is voltage division.

FIG. 1 is a configuration diagram of an internal voltage generating circuit as prior art.

Referring to FIG. 1, the internal voltage generating circuit includes a resistor string 110 including a plurality of series resistors connected between a power supply voltage terminal VDD and a ground voltage terminal VSS and a voltage selection circuit 120. The voltage selection circuit 120 selects voltage as internal voltage VREF of one from the plurality of nodes of the resistor string 110 in response to voltage selection information SEL_INFO. The internal voltage generating circuit determines a level of the internal voltage VREF depending on the selected node of the plurality of series resistor.

There is tradeoff relationship between a current consumed in the circuit and voltage setting time for each node of the resistor string 110 to reach targeted voltage from the start of operation of the internal voltage generating circuit. When resistances of resistors of the resistor string 110 are large, that is, all the resistances of the resistor string 110 is large, current consumed by the internal voltage generating circuit is reduced. However, the voltage setting time is required much. On the other hand, when the resistances of resistors of the resistor string 110 are small, current consumed by the circuit is increased. However, in this case, there is advantageous in that the voltage setting time is short.

According to recent needs for a memory device, the reference voltage VREF generated in the memory device needs to have a voltage level determined by a code in one of two or more preset ranges (A and B and C and D) with the preset voltage setting time.

SUMMARY

Exemplary embodiments of the present invention are directed to an internal voltage generating circuit capable of generating reference voltage in various ranges with small current consumption and fast voltage setting time.

In accordance with an embodiment of the present invention, an internal voltage generating circuit includes a first pull up resistor configured to be activated by a first range signal and connected between a pull up voltage terminal and a pull up common node; a second pull up resistor configured to be activated by a second range signal and connected between the pull up voltage terminal and the pull up common node; a first pull down resistor configured to be activated by the first range signal and connected between a pull down voltage terminal and a pull down common node; a second pull down resistor configured to be activated by the second range signal and connected between the pull down voltage terminal and the pull down common node; a resistor string including a plurality of series resistors connected between the pull up common node and the pull down common node; and a voltage selection circuit configured to select voltage of at least one of the plurality of nodes with which the series resistors are connected, in response to voltage selection information.

In accordance with another embodiment of the present invention, an internal voltage generating circuit includes a first pull up resistor configured to be activated by a first range signal and connected between a pull up voltage terminal and a pull up common node; a second pull up resistor configured to be activated by a second range signal and connected between the pull up voltage terminal and the pull up common node; a resistor string including a plurality of series resistors connected between the pull up common node and ground node; and a voltage selection circuit configured to select voltage of at least one of the plurality of nodes with which the series resistors are connected, in response to voltage selection information.

In accordance with still another embodiment of the present invention, an internal voltage generating circuit includes a first pull down resistor configured to be activated by the first range signal and connected between a pull down voltage terminal and a pull down common node; a second pull down resistor configured to be activated by the second range signal and connected between the pull down voltage terminal and the pull down common node; a resistor string including a plurality of series resistors connected between a pull up voltage terminal and the pull down common node; and a voltage selection circuit configured to select voltage of at least one of the plurality of nodes with which the series resistors are connected, in response to voltage selection information.

The internal voltage generating circuit may further include: a range signal generation unit configured to activate the first range signal with the second range signal activated in an initial period of the first range mode, or to activate the second range signal with the first range signal activated in an initial period of the second range mode.

DETAILED DESCRIPTION

Figure 1:
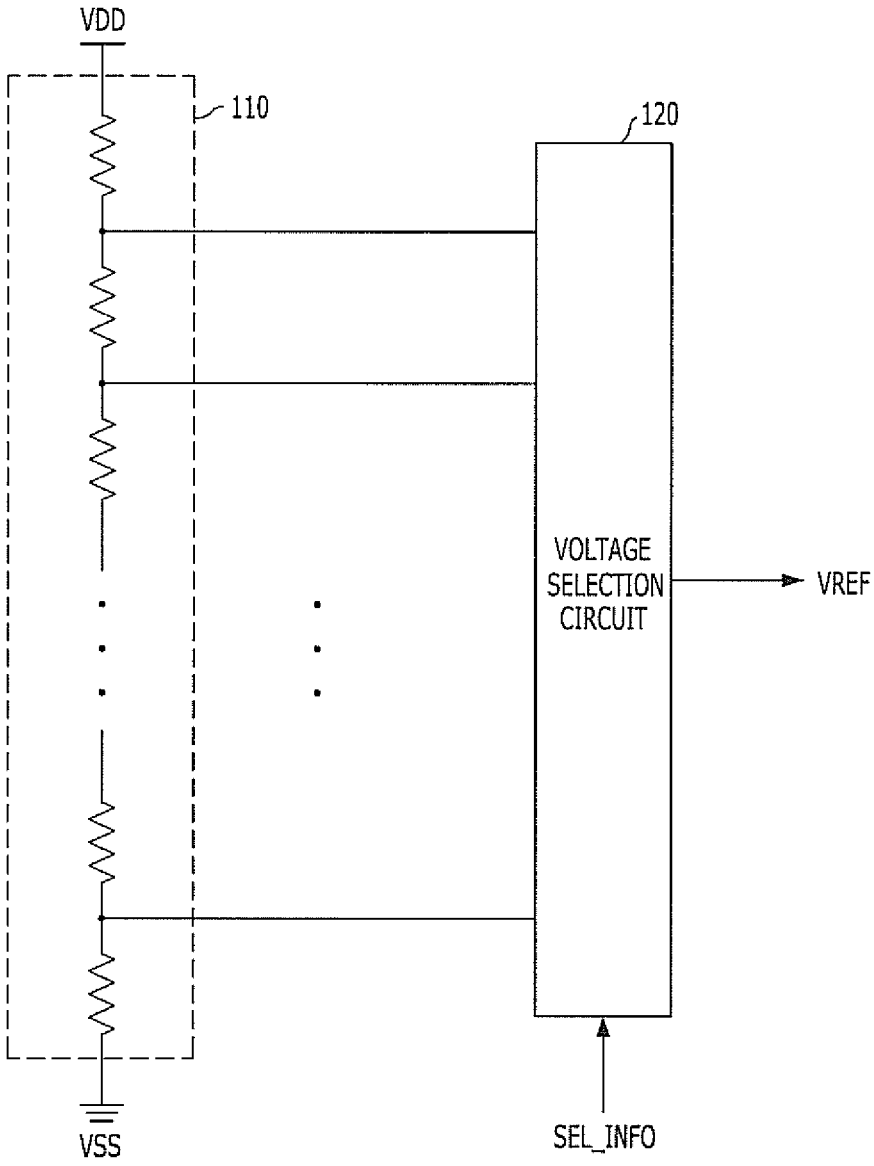
FIG. 1 (PRIOR ART)
FIG. 1 is a configuration diagram of an internal voltage generating circuit in accordance with the related art.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, reference numerals correspond directly to the like numbered parts in the various figures and embodiments of the present invention. It is also noted that in this specification, "connected/coupled" refers to one component not only directly coupling another component but also indirectly coupling another component through an intermediate component. In addition, a singular form may include a plural form as long as it is not specifically mentioned in a sentence.

Figure 2:
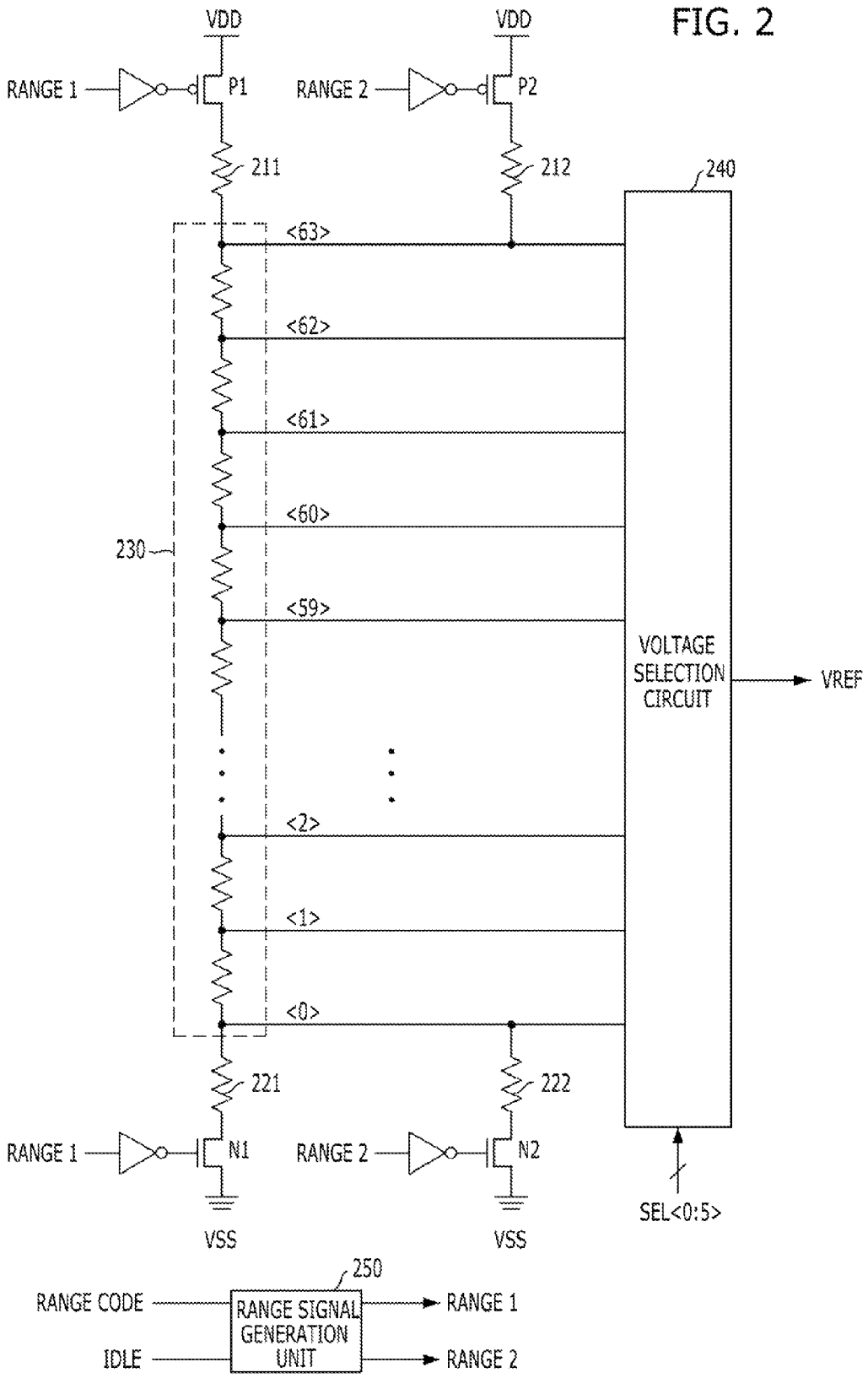
FIG. 2 is a configuration diagram of an internal voltage generating circuit in accordance with an embodiment of the present invention.

FIG. 2 is a configuration diagram of an internal voltage generating circuit in accordance with an embodiment of the present invention.

Referring to FIG. 2, an internal voltage generating circuit may include first (1st) and second (2nd) pull up resistors 211 and 212, 1st and 2nd pull down resistors 221 and 222, a resistance string 230, a voltage selection circuit 240, and a range signal generation unit 250.

The 1st pull up resistor 211 is activated in response to activation of a 1st range signal RANGE1 and is connected between a pull up voltage terminal VDD and a pull up common node <63>. The activation of the 1st pull up resistor 211 depends on a transistor P1 under the control of the 1st range signal RANGE1.

The 2nd pull up resistor 212 is activated in response to activation of a 2nd range signal RANGE2 and is connected between the pull up voltage terminal VDD and the pull up common node <63>. The activation of the 2nd pull up resistor 212 depends on a transistor P2 under the control of the 2nd range signal RANGE2. The 2nd pull up resistor 212 has a different resistance from the 1st pull up resistor 211.

The 1st pull down resistor 221 is activated in response to the activated 1st range signal RANGE1 and is connected between a pull down voltage terminal VSS and a pull down common node <0>. The activation of the 1st pull down resistor 221 depends on a transistor N1 under the control of the 1st range signal RANGE1.

The 2nd pull down resistor 222 is activated in response to the activated 2nd range signal RANGE2 and is connected between the pull down voltage terminal VSS and the pull down common node <0>. The activation of the 2nd pull down resistor 222 depends on a transistor N2 under the control of the 2nd range signal RANGE2. The 2nd pull down resistor 222 has a different resistance from the 1st pull down resistor 221.

The resistor string 230 is connected between the pull up and down common nodes <63> and <0>, and includes a plurality of series resistors. The resistor string 230 is serially connected with the 1st pull up and down resistors 211 and 221 in response to the activated 1st range signal RANGE1 to divide the power supply voltage VDD, thereby generating various voltages. Further, the resistor string 230 is serially connected with the 2nd pull up and down resistors 212 and 222 in response to the activated 2nd range signal RANGE2 to divide the power supply voltage VDD, thereby generating various voltages.

The voltage selection circuit 240 selects voltage out of the nodes <0> to <63> with which the series resistors of the resistor string 230 are connected, and output the selected voltage as the internal voltage VREF in response to the voltage selection information SEL <0:5>. The voltage selection circuit 240 may select two or more voltages out of the nodes <0> to <63> of the resistor string 230 and output two or more internal voltages VREFs.

The range signal generation unit 250 sets one of 1st and 2nd range modes in response to a range code. The range signal generation unit 250 activates the 1st and 2nd range signals RANGE1 and RANGE2 respectively when one of the 1st and 2nd range modes is set.

When the 1st range signal RANGE1 activated, the voltage, selected by the voltage selection information SEL <0:5>, among the voltages generated by the voltage division of the 1st pull up resistor 211, the resistor string 230, and the 1st pull down resistor 221 is outputted as the internal voltage VREF. When the 2nd range signal RANGE2 activated, the voltage, selected by the voltage selection information SEL <0:5>, among the voltages generated by the voltage division of the 2nd pull up resistor 212, the resistor string 230, and the 2nd pull down resistor 222 is outputted as the internal voltage VREF.

Since the resistances of the 1st and 2nd pull up resistors 211 and 212 are different, and the resistances of the 1st and 2nd pull down resistors 221 and 222 are different, the series resistances of the 1st pull up resistor 211, the resistor string 230, and the 1st pull down resistor 221 (which is selected in response to the range signal RANGE1), and the series resistances of the 2nd pull up resistor 212, the resistor string 230, and the 2nd pull down resistor 222 (which is selected in response to the range signal RANGE2) is different from each other. Thus, the ranges of the internal voltage VREF generated by the internal voltage generation circuit is different according to the 1st or 2nd range modes (activation of the range signals RANGE1 or RANGE2).

Meanwhile, the range signal generation unit 250 activates both of the 1st and 2nd range signals RANGE1 and RANGE2 in an initial period of the 1st and 2nd range modes. In this case, the 1st and 2nd pull up resistors 211 and 212, and the 1st and 2nd pull down resistors 221 and 222 are activated. Therefore, a large amount of current flows in the resistor string 230 in the initial period of the 1st and 2nd range modes, which allows each of the nodes <0> to <63> to reach a targeted voltage value rapidly. That is, the voltage setting time is reduced. Since time for activation of both of the 1st and 2nd range signals RANGE1 and RANGE2 is only the initial period of the 1st and 2nd range modes, it is possible to reduce the voltage setting time while maintaining the current consumption as small as possible in the internal voltage generating circuit.

In case of an idle mode where the internal voltage VREF is not generated in response to an activated idle signal IDLE, the range signal generation unit 250 deactivates both of the 1st and 2nd range signals RANGE1 and RANGE2. In this case, the internal voltage generating circuit does not generate the internal voltage VREF and thus the current consumption of the circuit is suppressed to the minimum.

Figure 3:
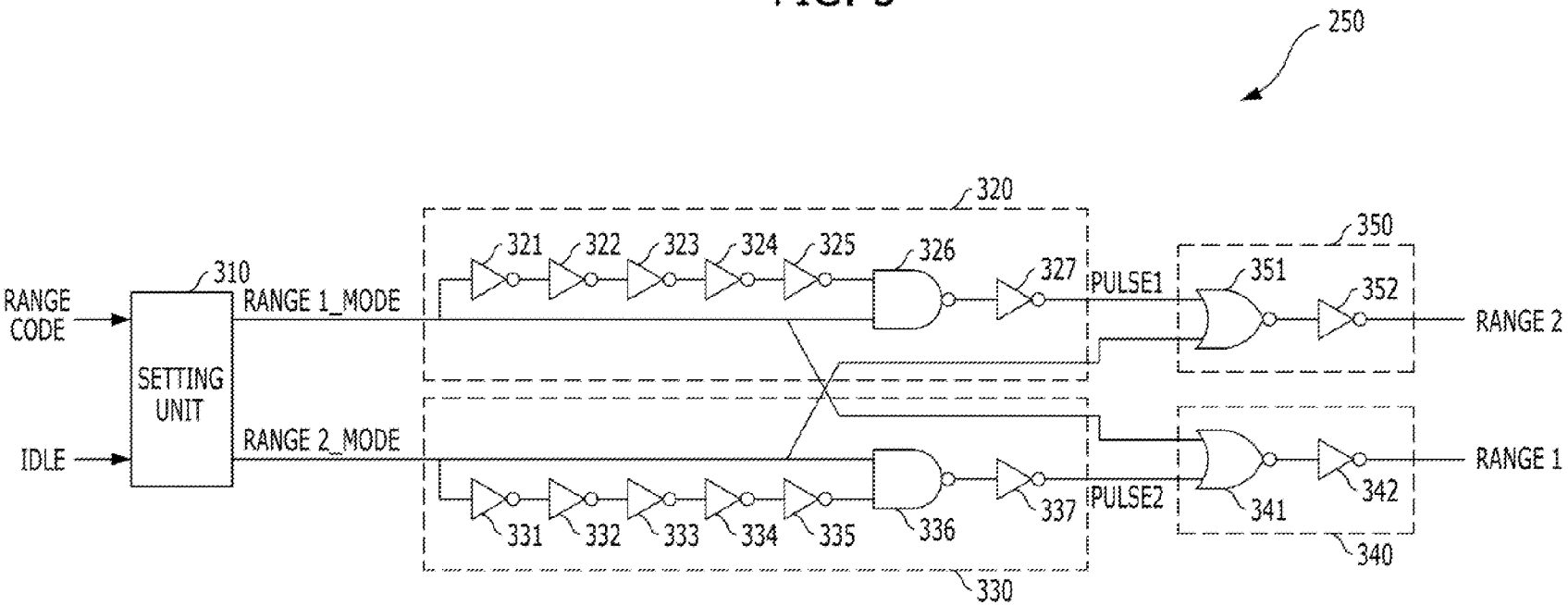
FIG. 3 is a configuration diagram of an embodiment of a range signal generation unit 250 of FIG. 2.

FIG. 3 is a configuration diagram of an embodiment of the range signal generation unit 250 of FIG. 2.

Referring to FIG. 3, the range signal generation unit 250 may include a setting unit 310, 1st and 2nd pulse generating units 320 and 330, and 1st and 2nd logic combination units 340 and 350.

The setting unit 310 activates one of a 1st and 2nd range mode setting signals RANGE1_MODE and RANGE2_MODE in response to the range code. The range code represents the range of the internal voltage VREF to be generated. The setting unit 310 deactivates both of the 1st and 2nd range mode setting signals RANGE1_MODE and RANGE2_MODE in response to the activated idle mode signal IDLE (the idle mode). In the memory device, a 10th bit value MR3 <10> of a mode register set 3 (MRS3) code may be the range code, and a mode for a period before power up and a self-refresh operation mode may correspond to the idle mode.

The 1st pulse generating unit 320 generates a 1st pulse signal PULSE1 that is activated at the beginning of the activation period of the 1st range mode setting signal RANGE1_MODE. The 1st pulse generating unit 320 may be configured to include inverters 321 to 325 and 327 and a NAND gate 326. The 2nd pulse generating unit 330 generates a 2nd pulse signal PULSE2 that is activated at the beginning of the activation period of the 2nd range mode setting signal RANGE2_MODE. The 2nd pulse generating unit 330 may be configured to include inverters 331 to 335 and 337 and a NAND gate 337.

The 1st logic combination unit 340 activates the 1st range signal RANGE1 in response to activation of at least one of the 1st range mode setting signal RANGE1_MODE and the 2nd pulse signal PULSE2. The 1st logic combination unit 340 may be configured to include a NOR gate 341 and an inverter 342. The 2nd logic combination unit 350 activates the 2nd range signal RANGE2 in response to activation of at least one of the 2nd range mode setting signal RANGE2_MODE and the 1st pulse signal PULSE1 is activated. The 2nd logic combination unit 350 may be configured to include a NOR gate 351 and an inverter 352.

Figure 4A:
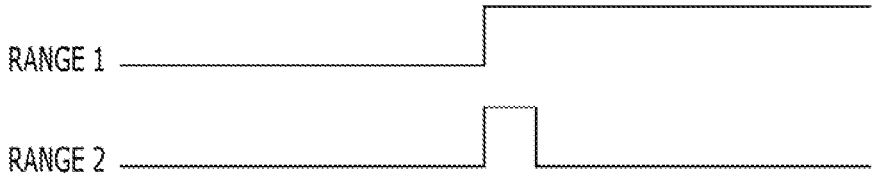
FIGS. 4A to 4C are diagrams illustrating waveforms of a first range signal RANGE1 and a second range signal RANGE2 generated by the range signal generation unit 250 of FIG. 3.
Figure 4B:
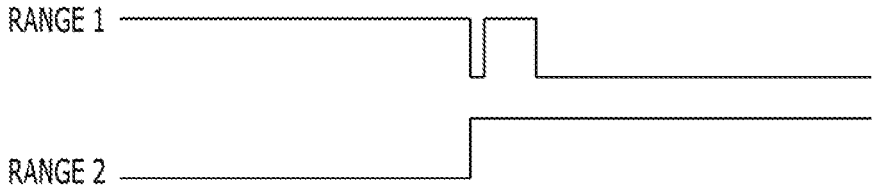
Figure 4C:
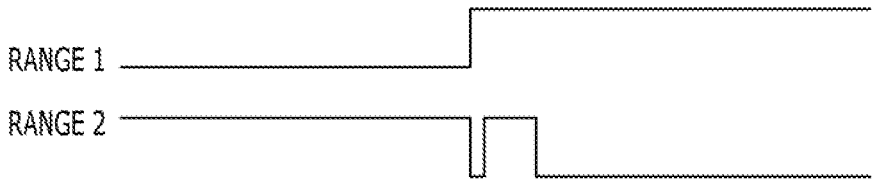

FIGS. 4A to 4C are diagrams illustrating waveforms of the 1st and 2nd range signals RANGE1 and RANGE2 generated by the range signal generation unit 250 of FIG. 3.

FIG. 4A illustrates the case in which the idle mode is changed to the 1st range mode. Referring to FIG. 4A, both of the 1st and 2nd range signals RANGE1 and RANGE2 are activated for the initial period of the 1st range mode and then, only the 1st range signal RANGE1 stays activated.

FIG. 4B illustrates the case in which the 1st range mode is changed to the 2nd range mode. Referring to FIG. 4B, both of the 1st and 2nd range signals RANGE1 and RANGE2 are activated for the initial period in which the mode is changed to the 2nd range mode and then, only the 2nd range signal RANGE2 stays activated.

FIG. 4C illustrates the case in which the 2nd range mode is changed to the 1st range mode. Referring to FIG. 4C, both of the 1st and 2nd range signals RANGE1 and RANGE2 are activated for the initial period in which the mode is changed to the 1st range mode and then, only the 1st range signal RANGE1 stays activated.

As illustrated in FIGS. 4A to 4C, in accordance with the embodiment of the present invention, both of the 1st and 2nd range signals RANGE1 and RANGE2 are activated for the initial period of the mode change. Therefore, the current flowing for the initial period in the internal voltage generating circuit may be instantly increased in response to the mode change. The increased current flow allows each of the nodes <0> to <63> of the circuit shown in FIG. 2 to reach a targeted voltage value rapidly, thereby reducing the voltage setting time.

Figure 5:
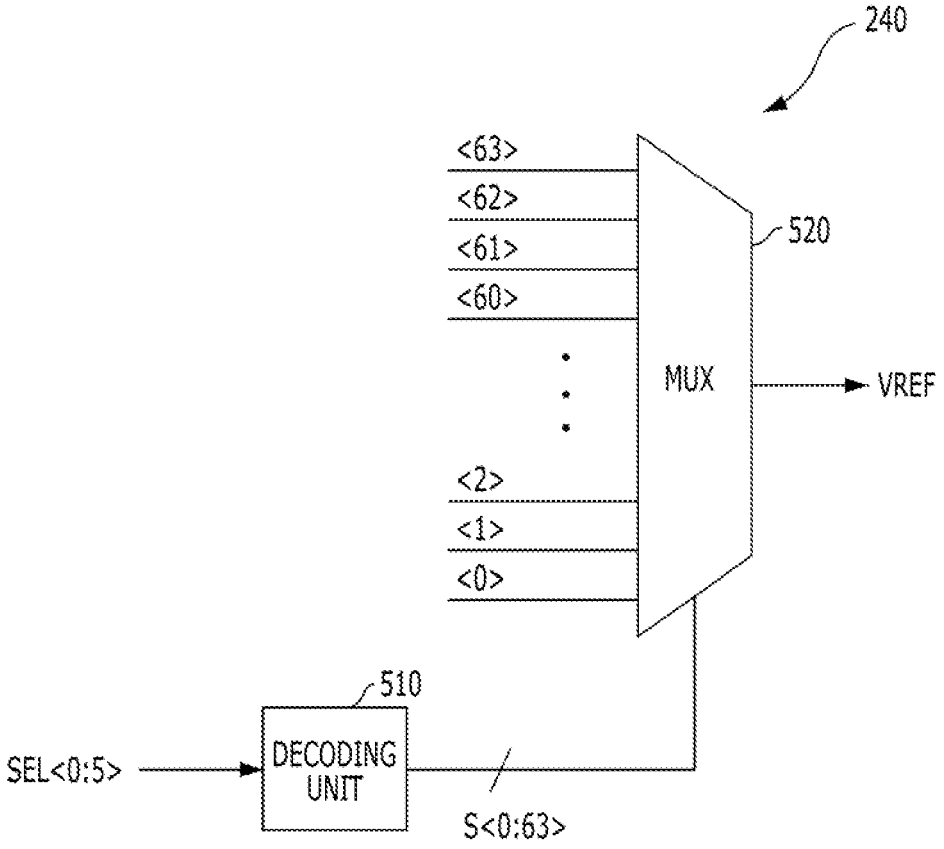
FIG. 5 is a configuration diagram of an embodiment of a voltage selection circuit 240 of FIG. 2.

FIG. 5 is a configuration diagram of an embodiment of the voltage selection circuit 240 of FIG. 2.

Referring to FIG. 5, the voltage selection circuit 240 may include a decoding unit 510 and a multiplexer 520.

The decoding unit 510 decodes the voltage selection information SEL <0:5> that is a binary code to generate a plurality of selection signals S <0:63>. The decoding unit 510 activates the selection signal corresponding to the value of voltage selection information SEL <0:5> among the plurality of selection signals S <0:63>. For example, when the voltage selection information is (0,0,0,0,0,0), the selection signal S <0> is activated, when the voltage selection information is (0,0,1,0,0,0), the selection signal S <8> is activated, when the voltage selection information is (1,1,1,1,1,1), the selection signal S <63> is activated. Here, the voltage selection information is illustrated as a binary code of 6 bits (SEL <0:5>) and thus, the total number of selection signals is illustrated as 64 (S <0:63>), but the bit number of voltage selection information SEL <0:n> and the number of selection signals S <0:2ôn−1> may vary. For reference, in the memory device, 4th to 9th bit values MR3 <4:9> of a mode register set 3 (MRS3) code may be the voltage selection information SEL <0:5>.

The multiplexer 520 selects voltage of one of nodes <0> to <63> as the internal voltage VREF in response to the plurality of selection signals S <0:63>. For example, when the selection signal S <13> is activated, the voltage of the node <13> is selected as the reference voltage VREF and when the selection signal S <37> is activated, the voltage of the node <37> is selected as the reference voltage VREF.

Figure 6:
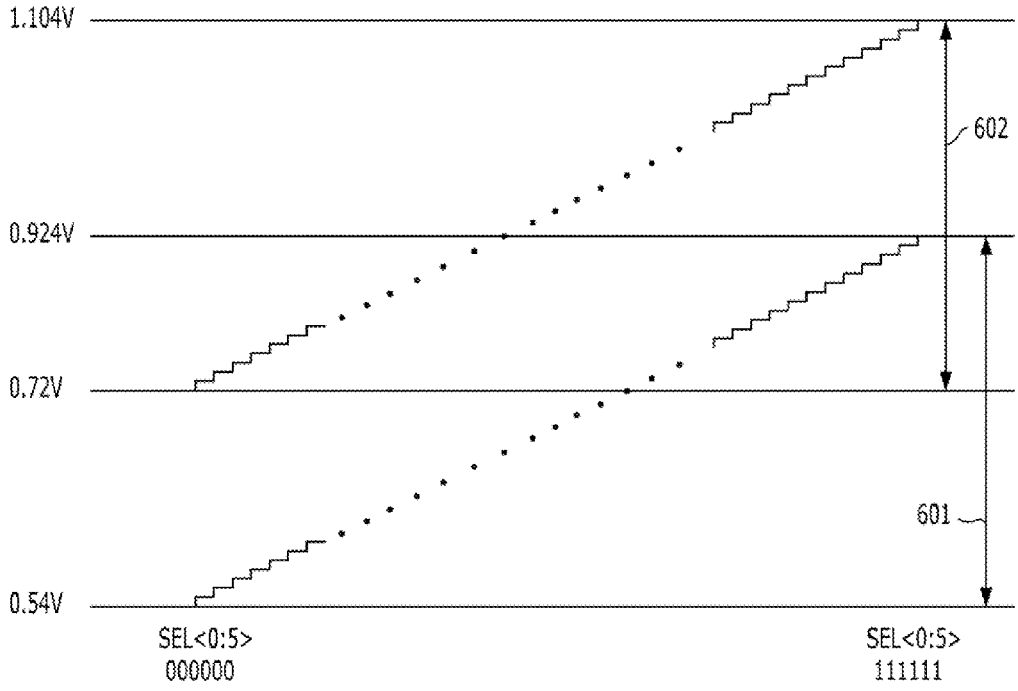
FIG. 6 is a diagram illustrating a range 601 of reference voltage VREF generated by voltage selection information SEL<0:5> in response to a first range mode and a range 602 of the reference voltage VREF generated by the voltage selection information SEL<0:5> in response to a second range mode.

FIG. 6 is a diagram illustrating ranges 601 and 602 of the reference voltage VREF generated by the voltage selection information SEL<0:5> respectively in 1st and 2nd range modes.

Referring to FIG. 6, the voltage value corresponding to the voltage selection information SEL <0:5> within the range 601 of 0.54 to 0.924V is selected as the reference voltage VREF in the 1st range mode. Similarly, the voltage value corresponding to the voltage selection information SEL <0:5> within the range 602 of 0.72 to 1.104V is selected as the reference voltage VREF in the 2nd range mode.

Figure 7:
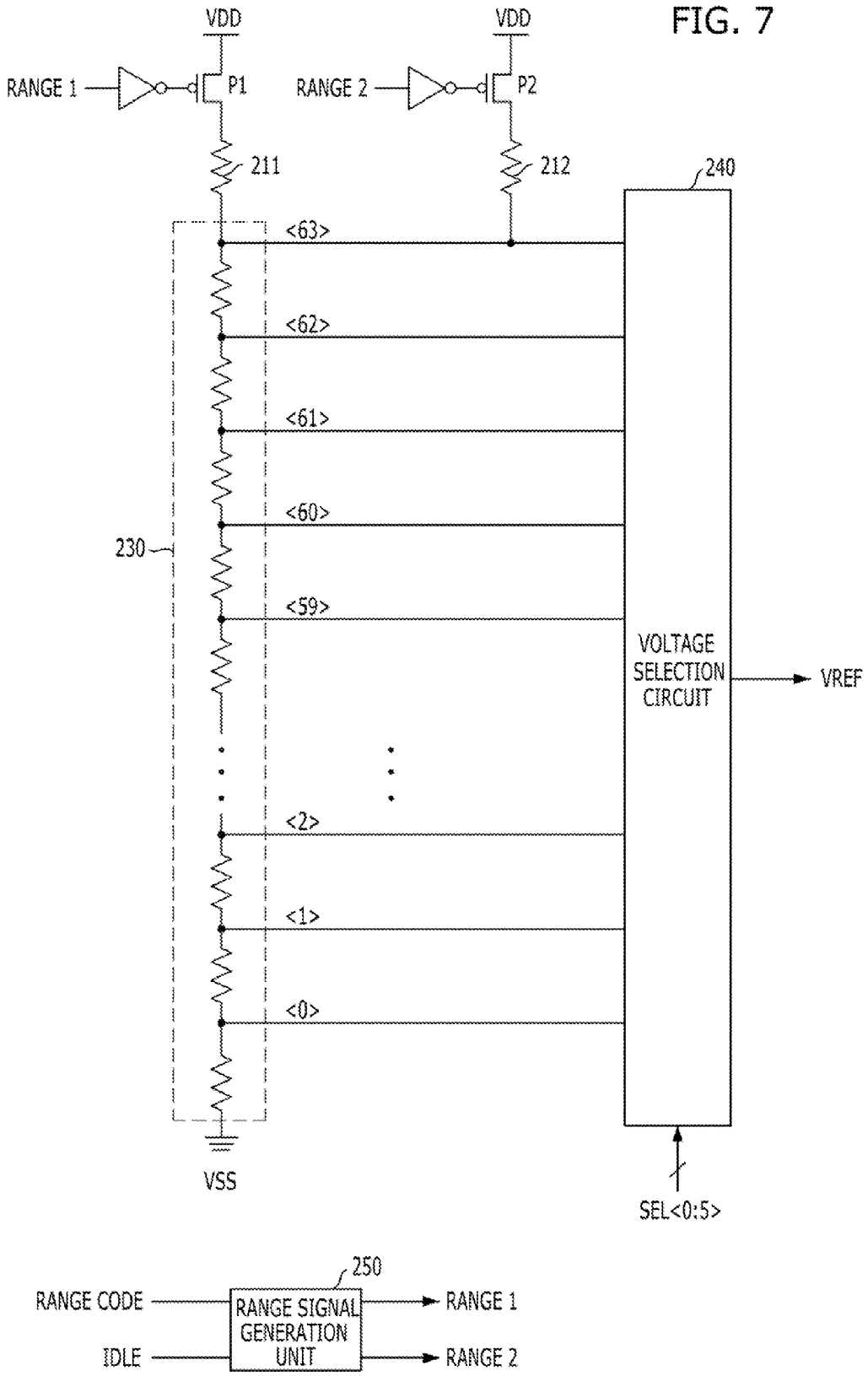
FIG. 7 is a configuration diagram of an internal voltage generating circuit in accordance with another embodiment of the present invention.

FIG. 7 is a configuration diagram of an internal voltage generating circuit in accordance with another embodiment of the present invention.

The circuit of FIG. 7 is embodied without the pull down resistors 221 and 222 of the embodiment of FIG. 2. As in the embodiment of FIG. 7, the pull up resistors 211 and 212 may produce the reference voltage VREF having different ranges.

In FIG. 7, the other components denoted by the same reference numerals as FIG. 2 may be configured and operated similar to FIG. 2.

Figure 8:
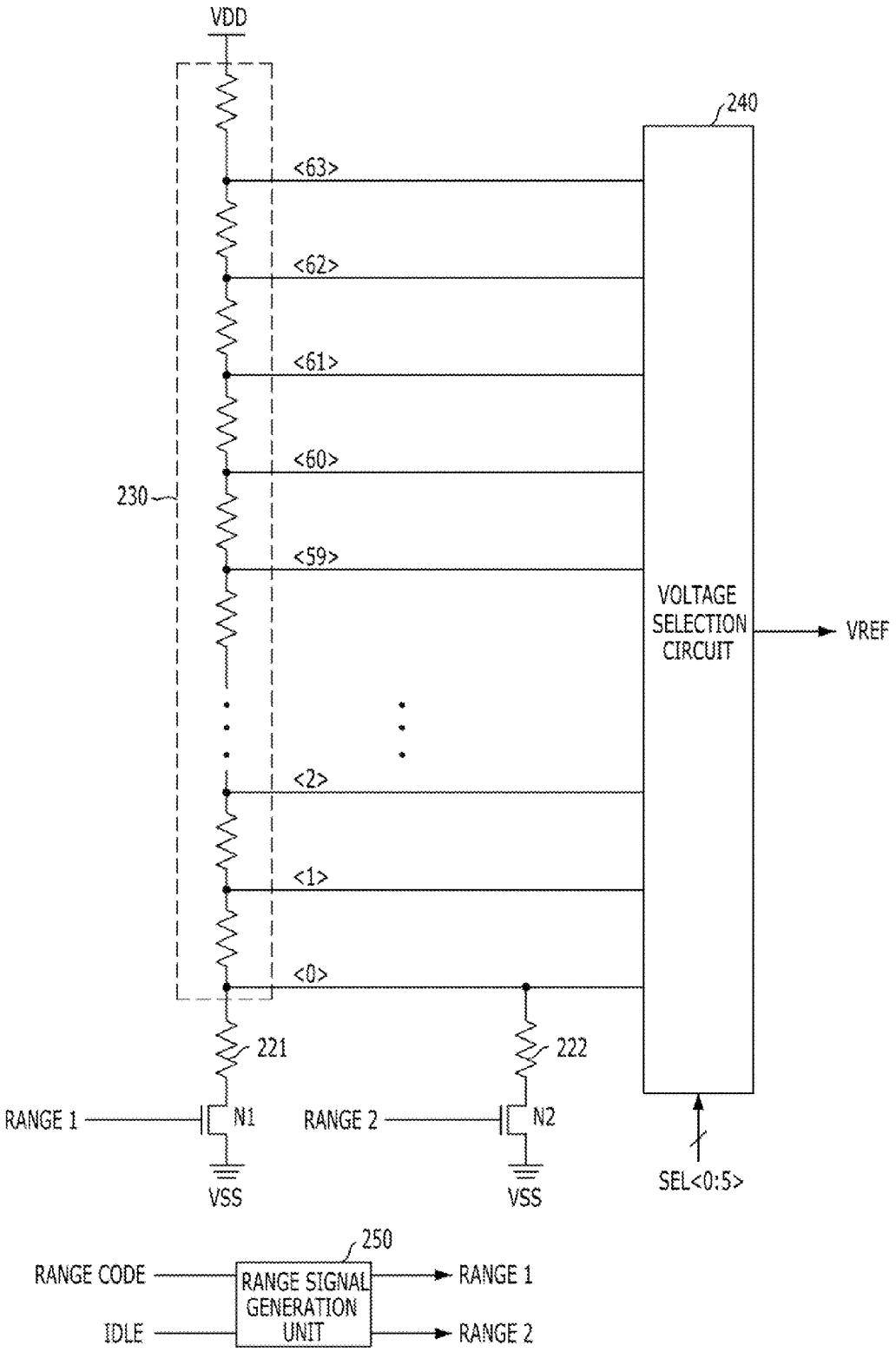
FIG. 8 is a configuration diagram of an internal voltage generating circuit in accordance with another embodiment of the present invention.

FIG. 8 is a configuration diagram of the internal voltage generating circuit in accordance with another embodiment of the present invention.

The circuit of FIG. 8 is embodied without the pull up resistors 211 and 212. As in the embodiment of FIG. 8, the pull down resistors 221 and 222 may produce the reference voltage VREF having different ranges.

In FIG. 8, the other components denoted by the same reference numerals as FIG. 2 may be configured and operated similar to FIG. 2.

In accordance with the embodiments of the present invention, it is possible to select the various voltage ranges by selecting the pull up resistor or the pull down resistor according to the range signals without any modification of the resistor string. Further, it is possible to shorten the voltage setting time with small current consumption.

Although the spirit of the present invention was described in detail with reference to the preferred embodiments, it should be understood that the preferred embodiments are provided to explain, but do not limit the spirit of the present invention. Also, it is to be understood that various changes and modifications within the technical scope of the present invention are made by a person having ordinary skill in the art to which this invention pertains.

What is claimed is:

1. An internal voltage generating circuit, comprising:

a first pull up resistor configured to be activated by a first range signal and connected between a pull up voltage terminal and a pull up common node;

a second pull up resistor configured to be activated by a second range signal and connected between the pull up voltage terminal and the pull up common node;

a first pull down resistor configured to be activated by the first range signal and connected between a pull down voltage terminal and a pull down common node;

a second pull down resistor configured to be activated by the second range signal and connected between the pull down voltage terminal and the pull down common node;

a resistor string including a plurality of series resistors connected between the pull up common node and the pull down common node; and a voltage selection circuit configured to select a voltage of at least one of a plurality of nodes with which the series resistors are connected, in response to voltage selection information.

2. The internal voltage generating circuit of claim 1, further comprising:

a range signal generation unit configured to activate the first range signal with the second range signal activated in an initial period of a first range mode, or to activate the second range signal with the first range signal activated in an initial period of a second range mode.

3. The internal voltage generating circuit of claim 2, wherein the range signal generation unit includes:

a first pulse generating unit configured to generate a first pulse signal activated at the beginning of an activation period of a first range mode setting signal;

a second pulse generating unit configured to generate a second pulse signal activated at the beginning of an activation period of a second range mode setting signal;

a first logic combination unit configured to activate the first range signal in response to activation of at least one of the first range mode setting signal and the second pulse signal; and a second logic combination unit configured to activate the second range signal in response to activation of at least one of the second range mode setting signal and the first pulse signal.

4. The internal voltage generating circuit of claim 1, wherein the voltage selection circuit includes:

a decoding unit configured to generate one or more selection signals based on the voltage selection information; and a multiplexer configured to select the voltage of at least one of the plurality of nodes, in response to the one or more selection signals.

5. The internal voltage generating circuit of claim 2, wherein the range signal generation unit deactivates the first and second range signals in response to an idle mode signal.

6. An internal voltage generating circuit, comprising:

a first pull up resistor configured to be activated by a first range signal and connected between a pull up voltage terminal and a pull up common node;

a second pull up resistor configured to be activated by a second range signal and connected between the pull up voltage terminal and the pull up common node;

a resistor string including a plurality of series resistors connected between the pull up common node and ground node; and a voltage selection circuit configured to select a voltage of at least one of a plurality of nodes with which the series resistors are connected, in response to voltage selection information.

7. The internal voltage generating circuit of claim 6, further comprising:

a range signal generation unit configured to activate the first range signal with the second range signal activated in an initial period of a first range mode, or to activate the second range signal with the first range signal activated in an initial period of a second range mode.

8. The internal voltage generating circuit of claim 7, wherein the range signal generation unit includes:

a first pulse generating unit configured to generate a first pulse signal activated at the beginning of an activation period of a first range mode setting signal;

a second pulse generating unit configured to generate a second pulse signal activated at the beginning of an activation period of a second range mode setting signal;

a first logic combination unit configured to activate the first range signal in response to activation of at least one of the first range mode setting signal and the second pulse signal; and a second logic combination unit configured to activate the second range signal in response to activation of at least one of the second range mode setting signal and the first pulse signal.

9. The internal voltage generating circuit of claim 6, wherein the voltage selection circuit includes:

a decoding unit configured to generate one or more selection signals based on the voltage selection information; and a multiplexer configured to select the voltage of at least one of the plurality of nodes, in response to the one or more selection signals.

10. The internal voltage generating circuit of claim 7, wherein the range signal generation unit deactivates the first and second range signals in response to an idle mode signal.

11. An internal voltage generating circuit, comprising:

a first pull down resistor configured to be activated by the first range signal and connected between a pull down voltage terminal and a pull down common node;

a second pull down resistor configured to be activated by the second range signal and connected between the pull down voltage terminal and the pull down common node;

a resistor string including a plurality of series resistors connected between a pull up voltage terminal and the pull down common node; and a voltage selection circuit configured to select a voltage of at least one of a plurality of nodes with which the series resistors are connected, in response to voltage selection information.

12. The internal voltage generating circuit of claim 11, further comprising:

a range signal generation unit configured to activate the first range signal with the second range signal activated in an initial period of a first range mode, or to activate the second range signal with the first range signal activated in an initial period of a second range mode.

13. The internal voltage generating circuit of claim 12, wherein the range signal generation unit includes:

a first pulse generating unit configured to generate a first pulse signal activated at the beginning of an activation period of a first range mode setting signal;

a second pulse generating unit configured to generate a second pulse signal activated at the beginning of an activation period of a second range mode setting signal;

a first logic combination unit configured to activate the first range signal in response to activation of at least one of the first range mode setting signal and the second pulse signal; and a second logic combination unit configured to activate the second range signal in response to activation of at least one of the second range mode setting signal and the first pulse signal.

14. The internal voltage generating circuit of claim 11, wherein the voltage selection circuit includes:

a decoding unit configured to generate one or more selection signals based on the voltage selection information; and a multiplexer configured to select the voltage of at least one of the plurality of nodes, in response to the one or more selection signals.

15. The internal voltage generating circuit of claim 12, wherein the range signal generation unit deactivates the first and second range signals in response to an idle mode signal.

* * * * *